US007630277B2

(12) United States Patent
Conus et al.

(10) Patent No.: US 7,630,277 B2
(45) Date of Patent: Dec. 8, 2009

(54) TIMEPIECE HAVING SPECIAL AESTHETICAL EFFECTS

(75) Inventors: Thierry Conus, Lengnau (CH); Paul Ris, Grenchen (CH); Sébastien Gass, Bienne (CH)

(73) Assignee: ETA SA Manfacture Horlogére Suisse, Grenchen (CH)

( * ) Notice: Subject to any disclaimer, the term of this patent is extended or adjusted under 35 U.S.C. 154(b) by 518 days.

(21) Appl. No.: 11/152,162

(22) Filed: Jun. 15, 2005

(65) Prior Publication Data

US 2005/0276168 A1 Dec. 15, 2005

(30) Foreign Application Priority Data

Jun. 15, 2004 (EP) ..... 04013927

(51) Int. Cl.
*G04B 19/00* (2006.01)
*G04B 19/02* (2006.01)

(52) U.S. Cl. ..... 368/220; 368/223

(58) Field of Classification Search ..... 368/220–223, 368/232–233
See application file for complete search history.

(56) References Cited

U.S. PATENT DOCUMENTS 5,359,578 A * 10/1994 Truini ..... 368/76
5,377,171 A * 12/1994 Schlup ..... 368/220
5,521,888 A * 5/1996 Fransen ..... 368/220
5,878,003 A * 3/1999 Gantet ..... 368/76
6,229,768 B1 5/2001 Nakazawa et al.
6,507,536 B1 * 1/2003 Keatch ..... 368/16
6,754,139 B2 * 6/2004 Herbstman et al. ..... 368/77
7,075,860 B2 * 7/2006 Dias ..... 368/77

FOREIGN PATENT DOCUMENTS

| | | | |
|---|---|---|---|
| DE | 37 10 406 A1 | | 10/1988 |
| DE | 200 02 174 U1 | | 4/2001 |
| EP | 0 195 369 A1 | | 9/1986 |
| EP | 1 003 085 A1 | | 5/2000 |
| FR | 2767930 | * | 3/1999 |
| JP | 07244173 | * | 9/1995 |

OTHER PUBLICATIONS

European Seach Report completed Jan. 12, 2005 in corresponding European Patent Application No. 04 01 3927.

* cited by examiner

*Primary Examiner*—Renee S Luebke
*Assistant Examiner*—Thanh S Phan
(74) *Attorney, Agent, or Firm*—Griffin & Szipl, P.C.

(57) ABSTRACT

Timepiece fitted with a movement, characterised in that it includes a plate (6) driven in rotation by the movement (1) and which carries at least two off-centre display members which rotate about themselves and which are coupled to each other by a gear train (67, 80) whose ratio determines the frequency with which the decorative designs covering the display members cooperate with each other to form a determined fancy decoration.

19 Claims, 4 Drawing Sheets

TIMEPIECE HAVING SPECIAL AESTHETICAL EFFECTS

This application claims priority from European Patent Application No. 04013927.1 filed Jun. 15, 2004, the entire disclosure of which is incorporated herein by reference.

The present invention concerns a timepiece providing special aesthetic effects. It concerns more particularly a timepiece allowing a determined image to appear periodically.

Timepieces comprising an attractive or original function, changing the appearance of the timepiece over time depending upon the relative position of the indicator members, in addition to the time indicating functions, have been known for a long time.

An example of a timepiece answering the generic definition hereinbefore is disclosed in European Patent Application No. 0 195 369 in the name of the Applicant. In this watch, the dial bears a decoration and is pierced with apertures in zones which do not touch the decoration itself. A disc which, in an ordinary watch, would be used for displaying the day of the week, bears a decoration corresponding to the central portion of the dial decoration. A ring which, in an ordinary watch, would be used to display the date, bears a decoration corresponding to the portion of decoration which is not on the disc. Because of this arrangement, the dial decoration appears alone, without any stray image being present in the apertures, every 217 days. The rest of the time, the disc and the ring allow portions of the decoration to appear in the apertures that give the whole a chaotic appearance.

The object sought is a special aesthetic effect involving shapes and colours. Different speeds driving the disc and the ring to those mentioned hereinbefore can be adopted. The disc may, for example, be driven at a rate of one complete revolution per week and the ring at a rate of one revolution per day. In such case, the coincidence will reoccur every seven days. In every case, the complete image will be reconstituted by designs borne by the disc and the rings cooperating with the designs borne by the dial. However, because the disc and the ring are arranged coaxially at the centre of the watch, the effect produced by this type of construction is quite monotonous.

It is an object of the present invention to overcome this drawback by providing a timepiece allowing an image of greater complexity to appear, whose appearance constantly changes.

The present invention thus concerns a timepiece fitted with a movement, characterised in that it includes a plate driven in rotation by the movement, which carries at lest two off-centre display members which rotate about themselves and which are linked to each other by a gear train whose ratio determines the frequency with which the decorative designs coating the members cooperate with each other to form a determined fancy decoration.

Owing to these features, the present invention provides a timepiece whose plate, by rotating, drives the display members in a rotational movement combined with a movement of revolution like a planetary wheel, these movements being regulated by the ratio of the gear train which couples said display members. It is thus possible to create a more complex and more dynamic image, which constantly changes the appearance of the watch. Assuming, for example, that there are five display members, and that each of these five display members can be coated with a decorative design chosen from among six decorative designs, it is possible to make 7776 watches all different from each other. This unique appearance of a given watch can be further reinforced by sizing the gear train such that the periodicity with which the designs carried by the display members coincide is long on the scale of human life. Consequently, the user will have a watch that will never have the same appearance from one reading to the next.

According to a complementary feature of the invention, the timepiece comprises a regulating member meshed with an escapement that itself meshes with a fixed wheel.

According to a first variant, the gear train is meshed with the escapement on the one hand, and the fixed wheel on the other hand.

According to a second variant, the gear train mounted on the plate meshes with a wheel set meshing with the fixed wheel.

Owing to these features, the speed, rotational direction and eccentricity of the display members can be chosen at will.

Other features and advantages of the present invention will appear more clearly from the following detailed description of an example embodiment of the timepiece according to the invention, this example being given purely by way of non-limiting illustration in conjunction with the drawing, in which.

The present invention proceeds from the general inventive idea which consists in fitting a timepiece with a rotating plate carrying display members that are able to rotate about themselves and together accompany the plate in its rotational movement. The possibilities of combining the decorative designs carried by the display members are thus practically limitless, which provides a watch displaying images that are more complex and more changeable and thus more attractive to the user.

Figure 1:
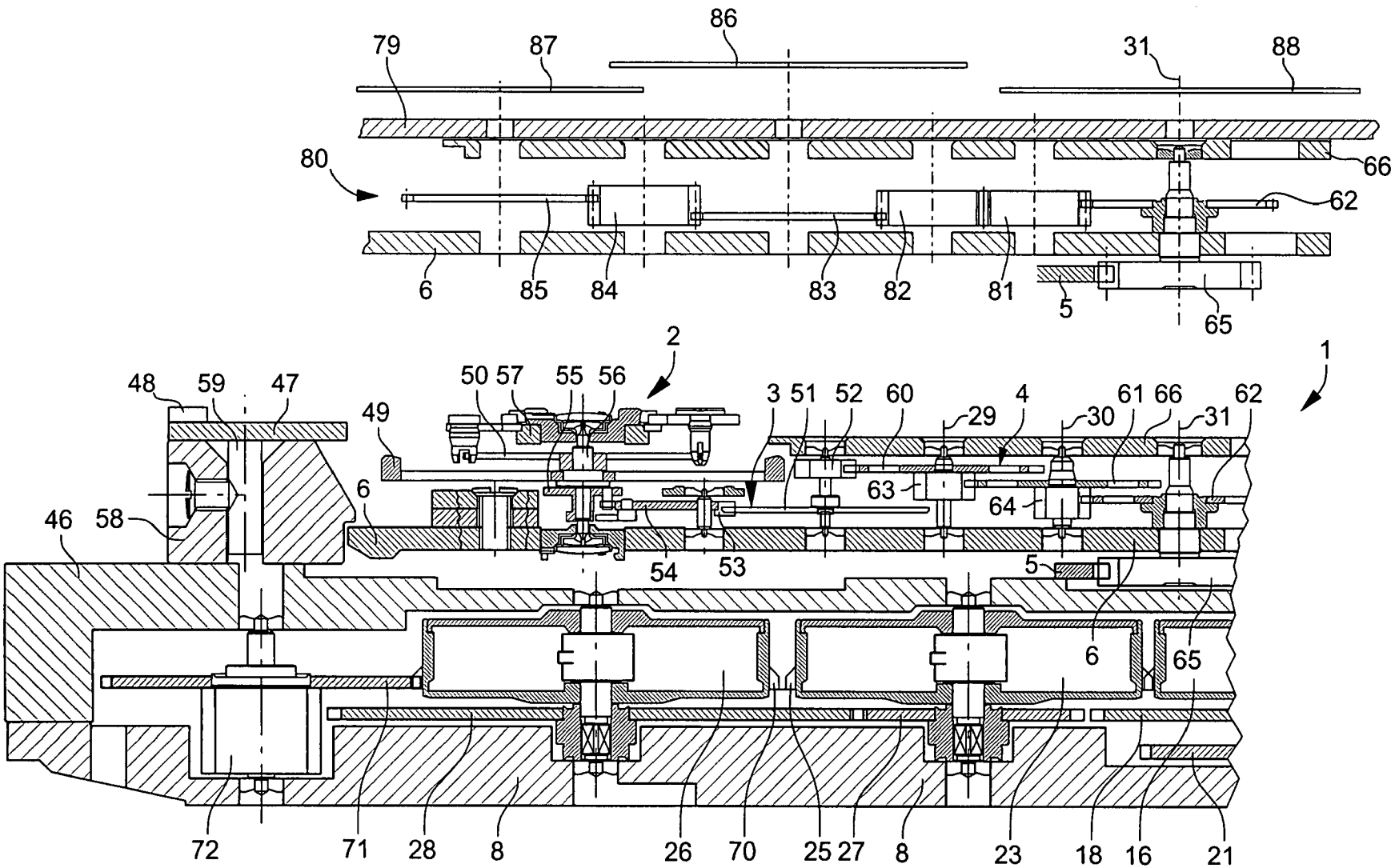
FIG. 1 is a schematic cross-section of the right part of the movement above which there is shown, also in cross-section and in a developed manner, the corresponding part of the display mechanism.
Figure 2:
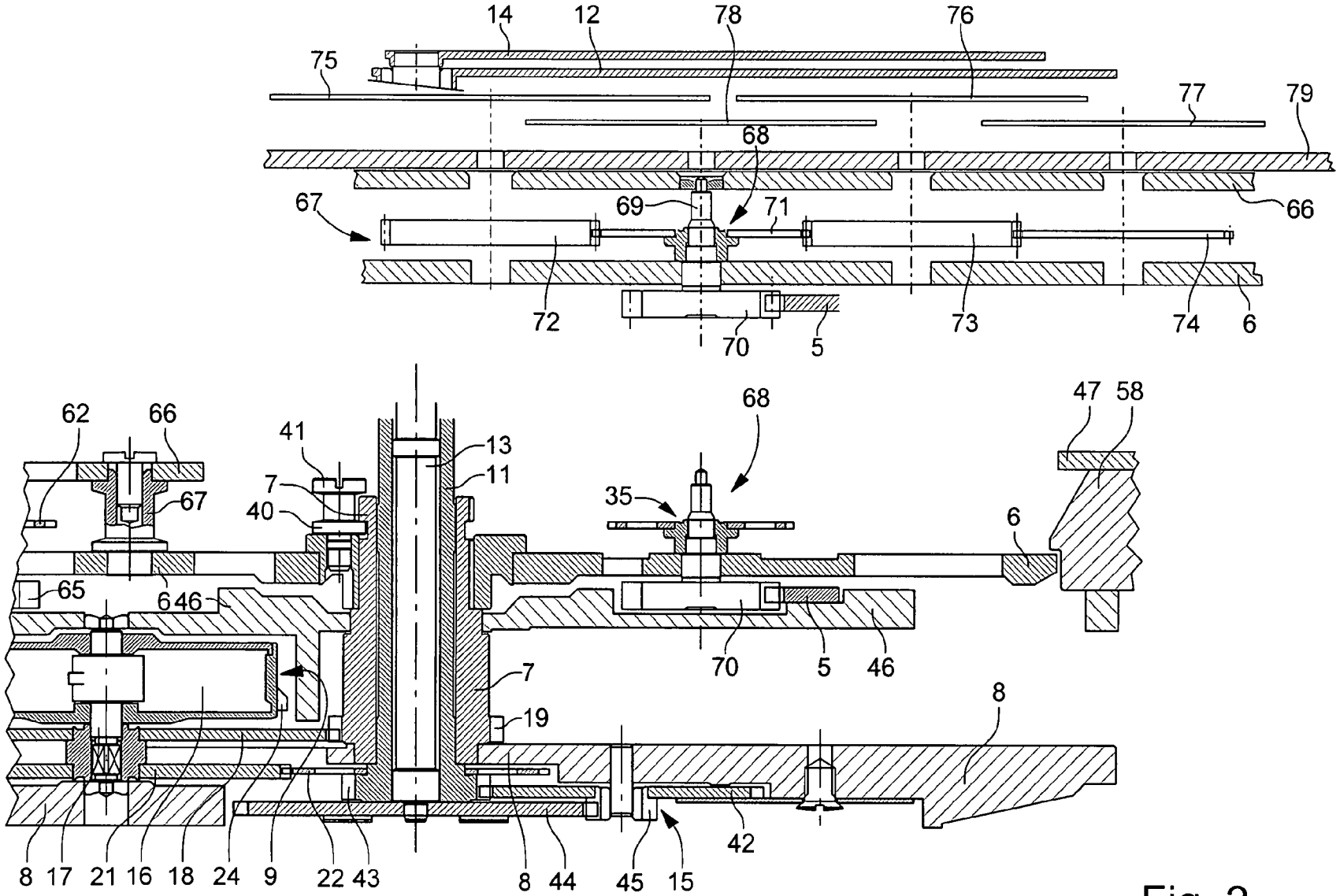
FIG. 2 is a schematic cross-section of the left part of the movement, above which there is shown, also in cross-section and in a developed manner, the corresponding part of the display mechanism.
Figure 3:
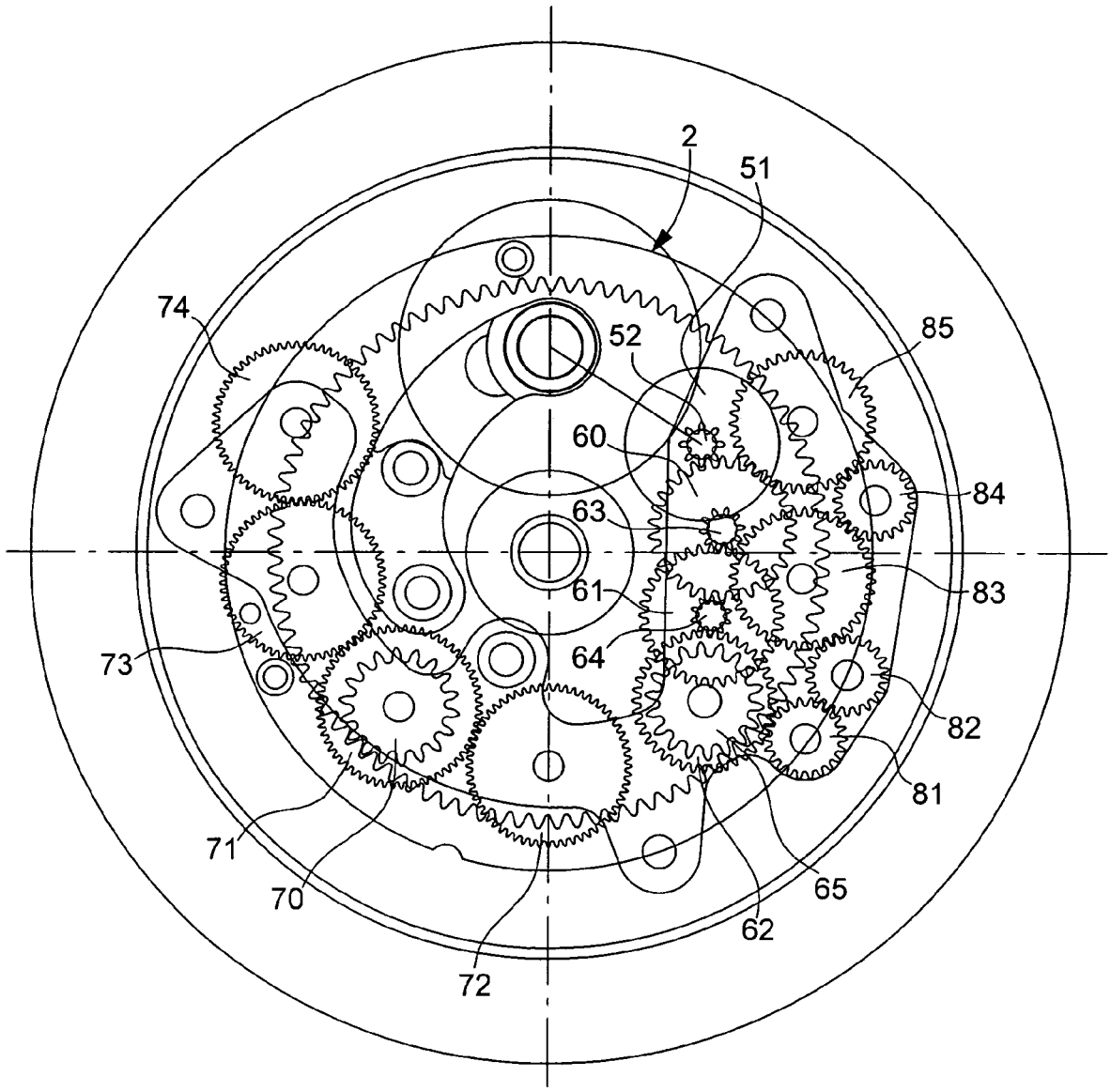
FIG. 3 is a top view showing the driving of the display members.
Figure 4:
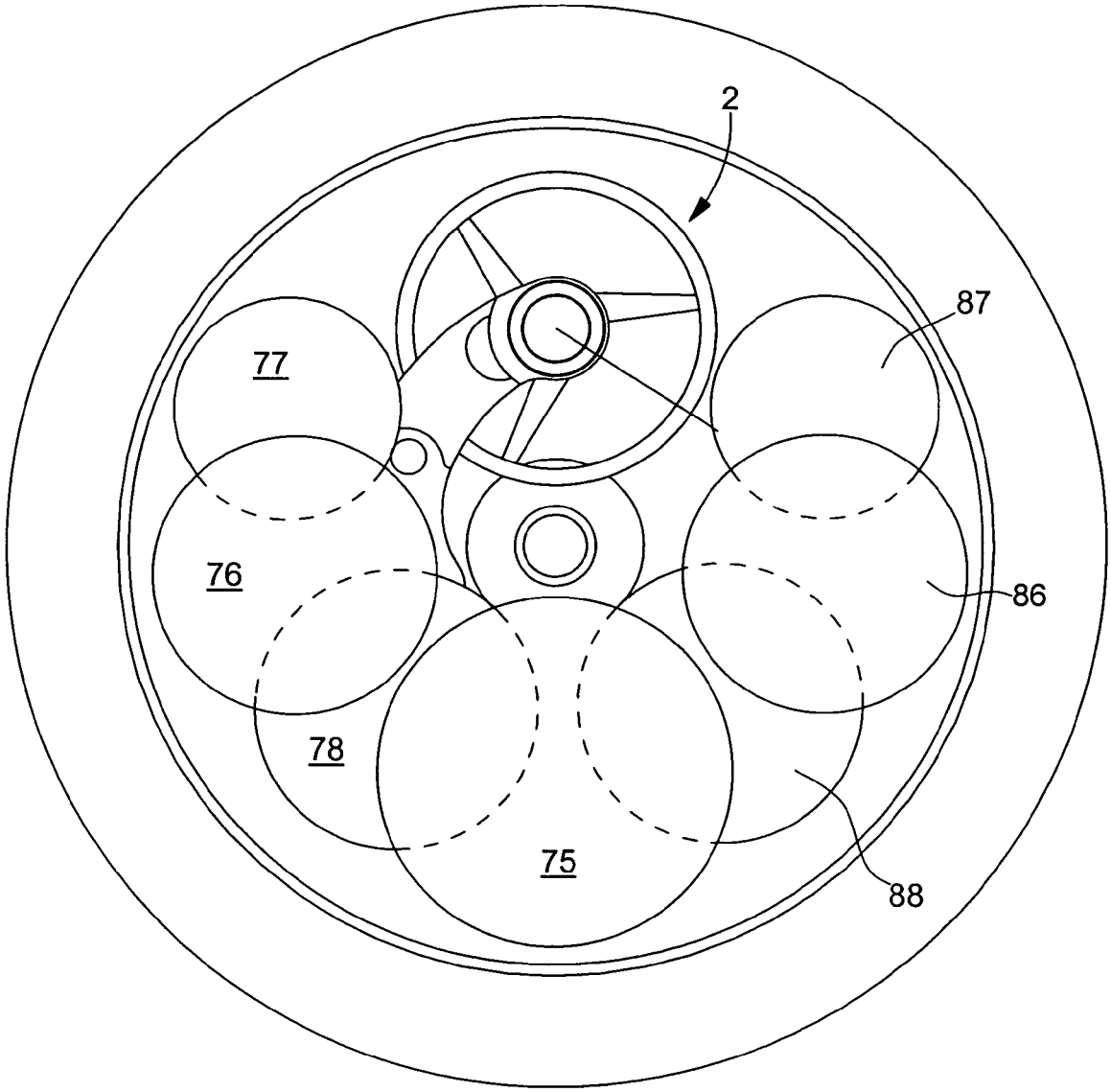
FIG. 4 is a top view of the display members.

As can be seen in FIGS. 1 and 2, movement 1 of the watch comprises a regulating member 2 meshed with an escapement 3, this latter being meshed with a gear train 4 meshing with a fixed wheel 5. Regulating member 2, escapement 3 and gear train 4 are mounted on a plate 6 secured to a tube 7 pivoting in a plate 8. Tube 7 is at the centre of the watch and is driven by a continuous movement of rotation by a motor member 9.

Fixed wheel 5 is located below plate 6, whereas tube 7 is rotatably engaged on a cannon-pinion 11 carrying a minute hand 12, this cannon-pinion being in turn rotatably engaged on an arbour 13 carrying an hour hand 14. The lower ends of arbour 13 and cannon-pinion 11 are coupled by a motion work 15 located lower than plate 8.

FIGS. 1 and 2 shows that motor member 9 comprises a barrel 16 which contains a spring that is not shown and whose arbour 17 carries a first ratchet 18. This ratchet 18 meshes with a pinion 19 which is secured to tube 7 to which plate 6 is fixed. Plate 6 can be fixed onto tube 7 in various ways. Here, we have chosen to use one, and preferably two, keys 40 which are rotated by means of the screw head 41 of the key in order to lock the plate on the tube.

The same Figures show that barrel arbour 17 carries a second ratchet 21, coaxial with the first ratchet 18 and located underneath the latter. Second ratchet 21 meshes with a wheel 22 friction mounted on cannon-pinion 11. Wheel 42 of motion work 15 meshes with pinion 43 of cannon-pinion 11. Likewise, hour wheel 44 of arbour 13 meshes with pinion 45 of motion work 15.

If a single barrel is deemed insufficient for the mechanism to have satisfactory autonomy, other barrels could be added in order to increase the duration of run of the watch. This is the case shown in FIGS. 1 and 2, where the first barrel 16 is preceded by a second barrel 23 comprising a spring meshed with the first barrel via toothings 24 and 25 of their respective drums. Moreover, FIG. 1 shows that the second barrel 23 is meshed with a third barrel comprising a spring 26 via the toothings of their respective ratchets 27 and 28. Motor member 9 thus includes three barrels in series.

It should be noted that the three barrels 16, 23 and 26 arranged in the same plane only occupy approximately three quarters of the available space in such plane about central tube 7. In the fourth quarter, it is possible to install an automatic winding mechanism engaging motor member 9, in this case its third barrel 26.

A ring shaped dial 47 provided with markings 48 surrounds plate 6. Ring 47 is held in a fixed circle 58 by means of dial feet 59.

It was indicated hereinbefore that tube 7 carrying plate 6 pivots in a plate 8. In fact, this plate 8 is secured to a barrel bridge or bar 46 in which tube 7 is also pivotably mounted, such that the tube is held in place radially and axially by plate 8 and by barrel bar 46 (see FIG. 2).

The two ratchets 18 and 21 fitted to barrel 16 can be of the same diameter or of different diameters. If they have the same diameter, it is clear that pinion 19 and wheel 22 will have the same diameter and that, consequently, cannon-pinion 11 and minute hand 12 which is coupled thereto will rotate at the same speed as tube 7 and plate 11 which is coupled thereto, i.e. on revolution per hour. In the example shown in FIG. 2, the diameter of ratchet 18 is greater than the diameter of ratchet 21, such that plate 6 will rotate faster than minute hand 12.

If one assumes that plate 6 rotates at the same speed as minute hand 12, the second ratchet 21 could be omitted, provided that tube 7 is friction engaged on cannon pinion 11. As a variant, therefore, one could have a motor member comprising a barrel whose arbour carries a ratchet meshing with a pinion secured to tube 7, this tube being friction engaged on cannon pinion 11.

Plate 6 and the elements mounted thereon will now be examined in more detail, in the construction illustrated in FIGS. 1 to 4. In this case, plate 6 is secured to tube 7, through which pass cannon pinion 11 and arbour 13 respectively carrying minute hand 12 and hour hand 14.

Regulating member 2, escapement 3 and gear train 4 are on plate 6, as is seen clearly in FIG. 1.

Regulator 2 comprises, in a conventional manner, a balance 49 and a balance spring 50. The escapement comprises escapement wheel 51 and its pinion 52, pallets 53, lever 54, large roller 55 and the balance staff 56. The balance staff pivots between plate 6 and a balance bridge 57 fixed to plate 6 by means of pillars (not shown). Gear train 4 comprises a plurality of wheel sets coupling via gears the escapement pinion 52 and the fixed wheel 5. There are three wheel sets here 29, 30 and 31, each comprising one wheel (respectively 60, 61 and 62) and one pinion (respectively 63, 64 and 65). These wheel sets pivot between plate 6 and a train bar 66. The train bar is fixed to plate 6 by means of pillars (not shown).

The number of wheel sets (here wheel sets 29, 30 and 31) forming gear train 4 and the gear ratios existing between the wheel sets will depend upon the balance frequency and the number of revolutions per unit of time selected for the rotation of plate 6. This train is in fact inserted between escapement 3 (more precisely escapement pinion 52) and fixed wheel 5. The features and peculiarities of the train thus impose on the plate a determined number of revolutions per unit of time.

An example of a preferred selection will be given here by way of example. Balance 49 oscillates at a rate of 21,600 vibrations per hour. If escapement wheel 51 is fitted with 20 teeth, the wheel and pinion 52, which is connected thereto, will make 540 revolutions per hour. Train 4 also comprises the three wheel sets 29, 30 and 31 with a gear ratio of 270 between escapement pinion 52 and the fixed wheel. As a result, plate 6 makes two revolutions per hour. It will be clear that other ratios could be chosen to obtain different speeds for plate 6.

A first gear train 67, carried by plate 6, meshes with a wheel set 68 meshing with fixed wheel 5. This gear train is shown in cross-section in FIG. 2 along a line that passes through the centres of the various pinions and wheels that form it. More specifically, FIG. 2 shows that wheel set 68 comprises an arbour 69 pivoting between plate 6 and train bridge 66, onto which are fitted a pinion 70 meshing with fixed wheel 5 and a wheel 71 meshing with gear train 67. This gear train 67 is formed of a first and a second pinion 72 and 73 both meshing with wheel 71, the second pinion 73 further meshing with a second wheel 74. Pinions 72, 73 and wheel 74 pivot between plate 6 and train bar 66.

Display members are fixed to the arbours of pinions 72, 73 and wheel 74 and to arbour 69, said display members taking the form, in the example shown in the drawing (see FIGS. 2 and 4), of four off-centre discs 75, 76, 77 and 78 respectively. As can be seen upon examining FIG. 2, discs 75 and 76 are arranged above discs 77 and 78. All of these discs carry different decorative designs and move above a dial 79 that is fixed to plate 6 by means of pillars (not shown). Dial 79 may also carry a decorative design that may cooperate with the designs added to the discs to form a determined fancy design when the position of dial 79 coincides with that of discs 75 to 78.

A second gear train 80, which is shown in cross-section in FIG. 1 along a line that passes through the various pinions and wheels forming the gear train, is also carried by plate 6 and meshes with wheel set 31 pivoted between plate 6 and train bar 66. It will be recalled that wheel set 31 comprises wheel 62 meshing with pinion 64 and pinion 65 meshing with fixed wheel 5 (see FIGS. 1 and 3). More specifically, this second gear train 80 is formed of a first and a second pinion 81 and 82 meshing with each other, pinion 82 meshing in turn with an intermediate wheel 83, itself meshed with a pinion 84 that drives a wheel 85. The set of wheels and pinions that form gear train 80 forms a kinematic chain pivoted between plate 6 and train bar 66. Display members are fixed to the arbours of wheels 83 and 85 and to the arbour of wheel set 31, said display members taking the form, in the example shown in the drawing (see FIGS. 1 and 4), of three off-centre discs 86, 87 and 88 respectively. As can be seen upon examining FIG. 1, disc 86 is arranged at a higher level than discs 87 and 88 and partially covers those discs. All of these discs move above dial 79 and can cooperate with the latter to form another part of the decoration when their respective positions coincide. It will be noted that hour hand 14 and minute hand 12 are mounted above the discs. Since these hands are thin and essentially mobile, they do not, however, hide the decoration.

It goes without saying that the invention is not limited to the embodiment that has just been described and that various simple modifications and variants can be envisaged by those skilled in the art without departing from the scope of the present invention as defined by the annexed claims. In particular, it will be noted that the display members could have any shape other than a disc, for example square, star-shaped or other and that the designs can be flat or three-dimensional. It will be noted here that the speed of dial 79 and the discs is such that the decoration is reformed once every six minutes. It will be understood however, that other ratios could be chosen in order to obtain different speeds for dial 79 and the discs.

What is claimed is:

1. A timepiece fitted with a movement, said timepiece including a plate driven in rotation by the movement, wherein the plate carries at least two off-center not coaxial display members which rotate about themselves and which are coupled to each other by a gear train whose ratio determines the frequency with which decorative designs covering said members cooperate with each other to form a determined fancy decoration.

2. The timepiece according to claim 1, further including a regulating member meshed with an escapement that itself meshes with a fixed wheel via a gear train.

3. The timepiece according to claim 2, wherein the gear train meshes with the escapement, and with the fixed wheel.

4. The timepiece according to claim 3, wherein the gear train, carried by the plate, is meshed with a wheel set including a wheel meshed with the escapement and a pinion meshed with the fixed wheel.

5. The timepiece according to claim 4, wherein the gear train is formed of a first and a second pinion and meshing with each other, the pinion in turn meshing with an intermediate wheel that itself meshes with a pinion which drives a wheel, display members being fixed to arbors of the wheels and to an arbor of the wheel set.

6. The timepiece according to claim 2, wherein the gear train meshes with a wheel set meshing with the fixed wheel.

7. The timepiece according to claim 6, wherein the gear train, carried by the plate, meshes with a wheel set meshing with the fixed wheel, this wheel set including an arbor onto which there are fitted a pinion meshing with the fixed wheel and a wheel meshing with said gear train.

8. The timepiece according to claim 7, wherein the gear train is formed of a first and a second pinion and both meshed with the wheel, the second pinion further meshing with a second wheel, display members being fixed to arbors of the pinions and of the wheel and to the arbor.

9. The timepiece according to claim 1, wherein the display members are discs.

10. The timepiece according to claim 9, wherein the discs move above a dial fixed to the plate.

11. The timepiece according to claim 10, wherein the dial carries a design which, with the other designs carried by the discs, forms a determined fancy design when the position of said dial and the positions of said discs coincide.

12. The timepiece according to claim 11, wherein some discs partially cover other discs.

13. The timepiece according to claim 10, wherein some discs partially cover other discs.

14. The timepiece according to claim 9, wherein some discs partially cover other discs.

15. The timepiece according to claim 1, wherein the at least two off-center not coaxial display members comprise four or more display members.

16. The timepiece according to claim 1, wherein the at least two off-center not coaxial display members comprise seven display members.

17. A timepiece fitted with a movement including:

a plate driven in rotation by the movement and that carries at least two off-center not coaxial display members that rotate about themselves and that are coupled to each other by a gear train whose ratio determines a frequency with which decorative designs covering said members cooperate with each other to form a determined fancy decoration;

wherein the plate is secured to a pivoting tube located at the center of the timepiece;

wherein the tube is rotatably engaged on a cannon-pinion carrying a minute hand; and wherein the cannon-pinion is in turn rotatably engaged on an arbor carrying an hour hand.

18. The timepiece according to claim 17, wherein the at least two off-center display members comprise four or more display members.

19. The timepiece according to claim 17, wherein the at least two off-center display members comprise seven display members.

* * * * *